US009615163B1

(12) United States Patent
Nachman et al.

(10) Patent No.: US 9,615,163 B1
(45) Date of Patent: Apr. 4, 2017

(54) SMART BASS REFLEX LOUDSPEAKER

(71) Applicant: Amazon Technologies, Inc., Reno, NV (US)

(72) Inventors: Ramez Nachman, Seattle, WA (US); Mohammed Aftab Alam, San Jose, CA (US)

(73) Assignee: Amazon Technologies, Inc., Reno, NV (US)

( * ) Notice: Subject to any disclaimer, the term of this patent is extended or adjusted under 35 U.S.C. 154(b) by 489 days.

(21) Appl. No.: 14/137,819

(22) Filed: Dec. 20, 2013

(51) Int. Cl.
*H04R 1/28* (2006.01)

(52) U.S. Cl.
CPC ..... *H04R 1/2826* (2013.01)

(58) Field of Classification Search
CPC .. H04R 1/2826; H04R 1/2823; H04R 1/2849; H04R 1/2846
See application file for complete search history.

(56) References Cited

U.S. PATENT DOCUMENTS

| | | | | |
|---|---|---|---|---|
| 7,266,204 | B2 * | 9/2007 | Watson | B60R 1/12 340/426.16 |
| 2009/0034768 | A1 * | 2/2009 | Lunner | H04R 25/453 381/318 |
| 2009/0122998 | A1 * | 5/2009 | Poortere | H04R 1/2826 381/59 |
| 2013/0037344 | A1 * | 2/2013 | Murray | H04R 1/2849 181/199 |

* cited by examiner

*Primary Examiner* — Sonia Gay
(74) *Attorney, Agent, or Firm* — Lee & Hayes, PLLC

(57) ABSTRACT

A loudspeaker port may include tunable physical components to tune the port to different frequencies to improve speaker efficiency at those frequencies. The ports may be activated by at least partly opening associated shutters, or disabled by closing the associated shutters. Activated ports may enhance speaker efficiency in a frequency range. However, activated ports may also introduce sound artifacts, thereby reducing sound quality. Therefore, the ports may be disabled when appropriate to reduce their negative impact to sound quality. A Digital Signal Processor (DSP) may determine the frequency components of a played sound to determine when to open the ports and how to tune the ports. Accordingly, a loudspeaker may benefit from the improved efficiency facilitated by the ports while also avoiding typical drawbacks created by the ports.

20 Claims, 8 Drawing Sheets

SMART BASS REFLEX LOUDSPEAKER

BACKGROUND

Loudspeaker devices often include a port, sometimes called a bass reflex port or a vent, to improve speaker output capabilities. A port may be associated with a particular resonant frequency to increase speaker efficiency at the particular frequency. Ports may enable improved speaker output at lower frequency ranges, which may offer greater sound fidelity over the entire frequency spectrum and/or sound better. Some speakers are designed to use multiple ports tuned to multiple frequencies, so as to further improve sound output at the multiple frequencies. Accordingly, ports may allow a speaker enclosure to be designed smaller, lighter, using less expensive materials, and/or having better overall sound quality.

Unfortunately, port usage may generally reduce sound quality under some circumstances. For example, transient sounds may not be faithfully reproduced by a ported speaker. Furthermore, port resonance may introduce undesirable sound artifacts. Additionally, although ports are typically beneficial for efficiency at low frequency ranges, a port may reduce speaker efficiency in other ranges, such as mid-range and/or high range.

A ported loudspeaker may increase speaker efficiency at low frequencies compared to a typical closed box loudspeaker. The physics describing the increase in the low frequency efficiency of a port is called the Helmholz Resonance, characterized by the following equation describing a cylindrical port:

$$f_H = \frac{\upsilon}{2\pi}\sqrt{\frac{A}{V_0 L}},$$

where $f_H$ is the resonant frequency of the port, $\upsilon$ is the speed of sound in the medium under consideration, A is the cross sectional area of the circular port, $V_0$ is the static volume of the cavity, and L is the length of the port. The equation may be adjusted as necessary to characterize ports of any shape. Proper tuning of the port may extend the low frequency response of a loudspeaker. Multiple ports may be tuned to multiple frequencies to enhance a wide range of frequencies.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Described herein are various techniques to tune a port of a loudspeaker and to selectively enable the port using a mechanical high speed shutter. Tuning the port may be accomplished by changing one or more physical properties of the port, for example by varying the length of the port, opening the shutter to varying degrees of openness, and varying the cross-sectional area of the port, etc. The mechanical high speed shutter may be operable to open and close to permit or impede airflow through the port. When the shutter is open, the port may be activated and may enhance speaker efficiency in the frequency range corresponding to the resonant frequency of the tuned port. When the shutter is closed, the port may be deactivated, thus reducing or eliminating the port's negative influence on sound properties such as transient response, undesired resonance, and the like. Furthermore, a deactivated port may improve speaker efficiencies in other ranges, such as mid or high frequency ranges.

In some embodiments, a digital signal processor (DSP) or the like, may analyze the frequency components of an input audio signal to determine a particular frequency to tune a port, provide actuation signals to tune the port and enable the port using a shutter. In various embodiments, the port may be tuned by varying the length of the port, operating the shutter to varying degrees of openness, or varying the cross-sectional area of the port, etc. Tuning the port and/or enabling the port may improve sound quality. For example, a low frequency sound may be more faithfully reproduced and/or sound better by activating one or more ports having a resonant frequency similar to the sound. The identified one or more ports may be opened (or remain open) to improve sound quality. Other ports may be closed (or remain closed), also to improve sound quality. Accordingly, the overall efficiency of the speaker may improve, particularly in the ranges corresponding to the open ports, while overall sound quality may not suffer from sound artifacts that may be introduced by opened ports.

Figure 1:
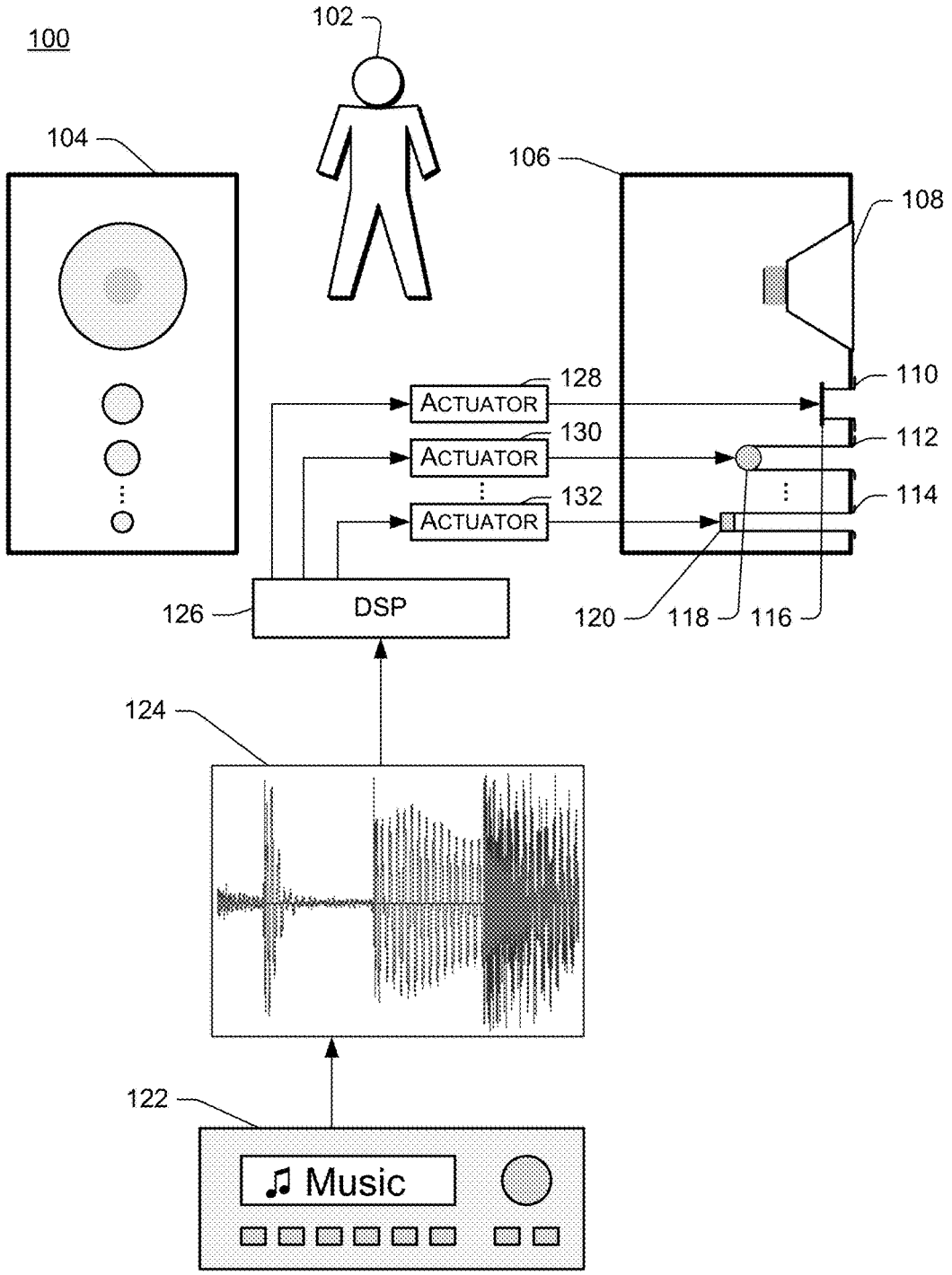
FIG. 1 is a block diagram of an illustrative environment configured to actuate components of a smart bass reflex loudspeaker.

FIG. 1 shows an illustrative environment 100 configured to actuate components of a smart bass reflex loudspeaker. A user 102 may listen to music, audio from human speakers, a movie soundtrack, or the like, from smart bass reflex loudspeakers 104 and 106. A front view of one smart bass reflex speaker 104 illustrates an example loudspeaker as seen from the front. A cross-sectional view of a second smart bass reflex speaker 106 illustrates an example loudspeaker as a cross-sectional illustration to better show the inner components of the cross-section view speaker 106.

The cross-section view speaker 106 comprises a driver 108, a first port 110, a second port 112 and an $n^{th}$ port 114. In general, any of the first port 110, the second port 112, and/or the $n^{th}$ port 114 may be tuned to any resonant frequency. For example each port may be tuned to different resonant frequencies. In other examples, some or all of the ports may be tuned to the same resonant frequency. In general, each port may have the same or different sizes. The front view speaker 104 shows similar components—driver, first port, second port, and nth port—from the front to illustrate that the components are annular in design, although other shapes may be possible. Further, while three ports are shown in this example implementation, speakers may be designed to have any number of ports.

Cross-section view speaker 106 further comprises a first shutter 114, a second shutter 116 and an $n^{th}$ shutter 120. As depicted herein, the first shutter 114 is connected to the first port 110, the second shutter 116 is connected to the second port 112 and the $n^{th}$ shutter 120 is connected to the $n^{th}$ port 114. The first shutter 114, the second shutter 116 and the $n^{th}$ shutter 120 may be any type of mechanical and/or electronic device capable of switching on and off (opening or closing) so as to allow or impede airflow through the associated port. A closed port may be described as being deactivated, disabled or off, and an open port may be described as being activated, enabled, or on.

The first shutter 114, the second shutter 116 and the $n^{th}$ shutter 120 may be identical, similar, or different. Each of the first shutter 114, the second shutter 116 and the $n^{th}$ shutter 120 may be differently sized, for example to match the size of the first port 110, the second port 112 and the $n^{th}$ port 114, respectively.

Each of the first shutter 114, the second shutter 116 and the $n^{th}$ shutter 120 depict example embodiments of a shutter. In general, any type of mechanism that enables control of airflow through a port can be generically referenced as a "shutter," throughout this disclosure.

In general, a shutter may open and/or close in response to an activation input. For example, the shutter may open and/or stay open when the activation input is enabled, and likewise the shutter may close and/or stay closed when the activation input is disabled. In some examples, the activation input may be an electronic signal, for example a '0' or '1' digital logic signal, or the like. In some examples, the activation input may be a mechanical input, such as a lever, which may be operated by a servo, or the like. In some embodiments, the shutter may be opened to varying degrees of openness. For example, the shutter may be half opened, 10% opened, or the like. In various embodiments, the shutter may be opened by an actuator. In some examples, the shutter openness may be changed by an actuator configured to change a shutter position.

The shutter may draw power from a power supply, a battery, from a dedicated power input, and/or from an activation input. In some examples, the shutter may rest in a closed position and may draw power to open, or vice versa. In some examples, the shutter may not require a power supply. For example, a mechanical shutter may not require electric power.

A shutter may have permeance characteristics, for example being impermeable when closed and free-flowing when opened. In some embodiments, the shutter may have imperfect permeance characteristics, though the shutter may still be very good in practical use, for example by impeding airflow enough to attenuate undesired noise in the range of human hearing. In various embodiments, the permeance of a shutter may correspond to the openness of the shutter.

In general, shutters may operate quickly. As described herein, particularly with respect to FIG. 6, techniques may be applied to compensate for the operating time of the shutters. Additionally, the first shutter 114 and the second shutter 116 may be constructed to operate quietly, so that their operation does not introduce unwanted sounds.

Although cross-section view speaker 106 illustrates three ports and three shutters, the techniques described herein may extend to any number of ports and/or shutters. In some embodiments, each port may have a shutter. In other embodiments, not every port may have a shutter.

An amplifier 122 may provide a sound output 124 to front view speaker 104 and/or cross section view speaker 106, or the like. The amplifier 122 is depicted here playing music, although any type of sound playback is contemplated. The sound output 124 is depicted here as a waveform, depicting sound output graphed over a period of time, however the sound output 124 may be, for example, a typical speaker output from the amplifier 122. The illustrative environment 100 generally highlights the shutters and related components, however the system does not depict, but may still use, a typical connection between the amplifier 122 and the front view speaker 104 and/or the cross-section view speaker 106 to facilitate sound playback.

A Digital Signal Processor (DSP) 126 may receive the sound output 124 and process the sound output 124 to determine component frequencies of the sound output. The DSP 126 may be any type of processing device, including, for example, a processor designed specifically for signal processing and labeled as a DSP, a general purpose computer, a mobile processing device such as a mobile phone or a tablet computer, an embedded computer, digital logic gates, a filter (such as a band pass filter), a spectrum analyzer (such as a swept-tuned spectrum analyzer), or the like. In some embodiments, the DSP 126 may be built into a speaker, for example, built into the front view speaker 104 and/or built into the cross-section view speaker 106. In some embodiments, the DSP 126 may be built into the amplifier 122 or may be a separate unit.

The sound output 124 may be provided as a continuous signal (such as an analog signal) and/or as a discrete signal (such as a pulse-code modulation (PCM) encoded signal).

In some embodiments, the sound output 124 may come from a streamed source, having a movable stream position. The streamed source may therefore be read and processed ahead of playback. For example, the streamed source may be a music file, capable of being read and/or analyzed prior to playback. In other examples, the sound output 124 may come from a live source, not generally capable of being read and/or analyzed prior to playback.

The sound output 124 may be processed as a sample, having discrete time values associated with signal values. The sample may be taken from a streamed source, or created from a live source.

The DSP 126 may be configured to determine one or more frequency components of the sound output 124. For example, a Fourier Transformation (FT) of the sound output 124 may convert the sound output 124 from the time domain to the frequency domain, represented as frequency bins, which generally indicate sound activity in particular frequency ranges for a sampled period. In general, one or more bins of the frequency bins may be associated with a coefficient corresponding to the strength of the associated frequency. In general, the FT may be calculated using a Fast Fourier Transformation (FFT), or any other suitable process to numerically determine and/or approximate the FT.

In general, a port may have a tunable range, wherein the port may be tuned to a particular resonant frequency within the tunable range. The port may then improve speaker efficiency when playing sounds including the particular frequency. Thus, one or more FFT result bins may correspond to the tunable resonant frequency range of a port. Additionally, the one or more FFT result bins may correspond to the particular resonant frequency of the port. Accordingly, when sound activity exists in an FFT result bin, a port having a tunable range that includes a particular resonant frequency of the sound activity may be tuned to the resonant frequency and a shutter of the port may be opened (or kept open) to improve efficiency during playback as described herein. In some examples, the FFT bin resolution may be selected to balance the accuracy and/or precision desired in a smart bass reflex loudspeaker against the performance costs of determining frequency components. For example, if a port has a wide tunable range, then fewer FFT bins may be needed to determine whether the port can be tuned to match the sound activity, and therefore the FFT may be performed using fewer resources. In some examples, one or more ports may be designed to have tunable ranges that can be determined relatively quickly.

A first actuator 128, a second actuator 130 and an $n^{th}$ actuator may be configured to open and/or close the first shutter 116, the second shutter 118, and/or the $n^{th}$ shutter 120, respectively. In some embodiments, the actuator 128, the actuator 130 and/or the actuator 132 may include a relay switch, one or more logic gates, and/or a physical switching device. For example, the actuator 128, the actuator 130 and/or the actuator 132 may include a multiplexor to activate an output (i.e. open a corresponding shutter) when the DSP 126 indicates activity in a frequency range corresponding to a port. The first actuator 128, the second actuator 130 and/or the $n^{th}$ actuator 130 may be located at the DSP 126, located in or near the speakers, or any other location. In various embodiments, a shutter may be opened to a particular degree, for example 50% open.

Figure 2:
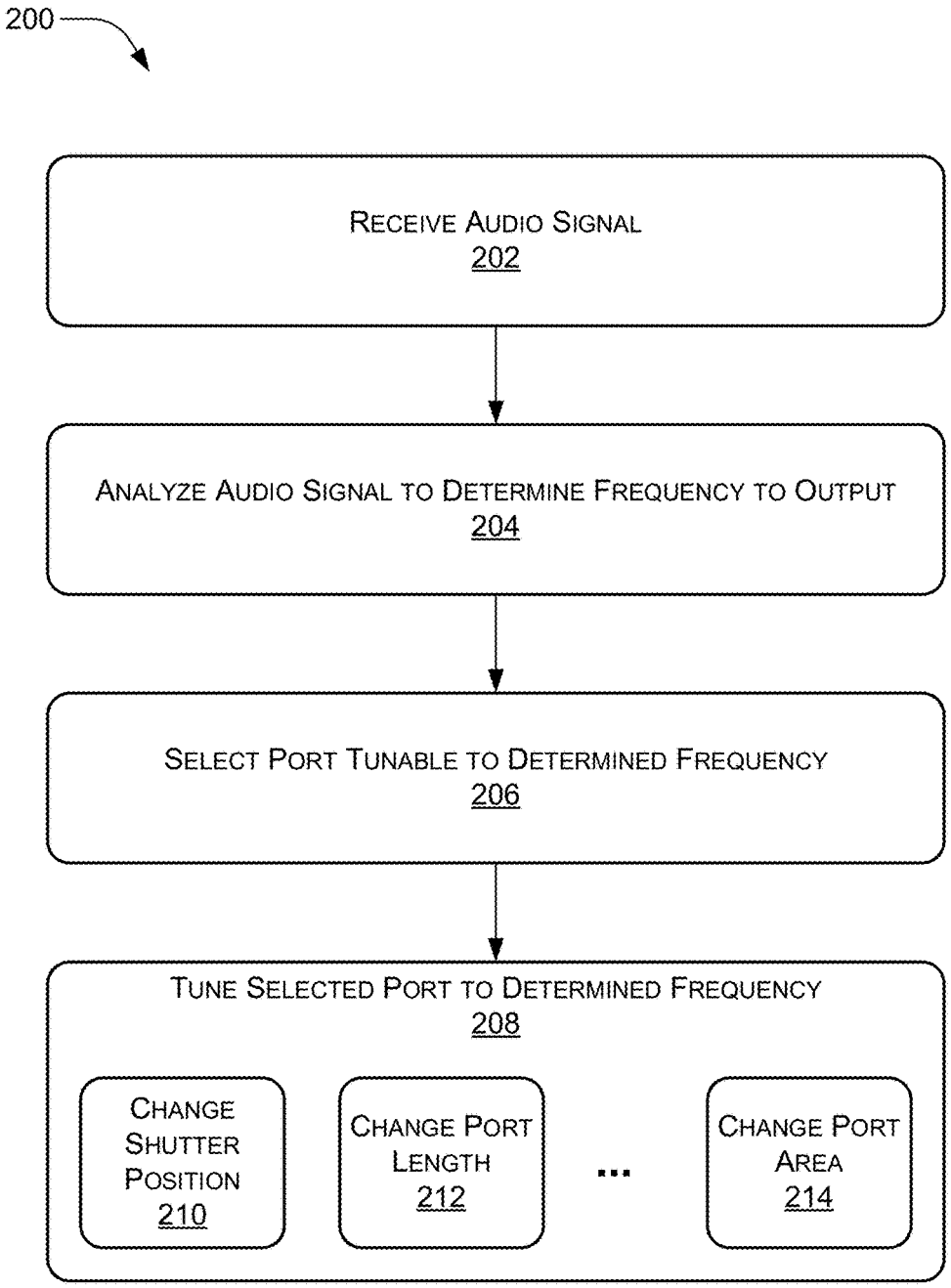
FIG. 2 is a flowchart showing an illustrative process to adjust features of a smart bass reflex loudspeaker in response to sound analysis.

FIG. 2 depicts an illustrative process 200 to adjust features of a smart bass reflex loudspeaker in response to sound analysis. The process is illustrated as a collection of blocks in a logical flow graph, which represent a sequence of operations that can be implemented in hardware, software, or a combination thereof. In the context of software, the blocks represent computer-executable instructions stored on one or more computer-readable storage media that, when executed by one or more processors, perform the recited operations. Generally, computer-executable instructions include routines, programs, objects, components, data structures, and the like that perform particular functions or implement particular abstract data types. The order in which the operations are described is not intended to be construed as a limitation, and any number of the described blocks can be combined in any order and/or in parallel to implement the processes.

FIG. 2 shows a process 200 performed on the DSP 126 when playing sounds such as music, as described above, particularly with respect to FIG. 1. In general, portions of the process 200 may be performed for each active port, for example a system having two active ports may perform portions of process 200 to tune each port.

At 202, an audio signal is received. For example, a speaker may receive the audio signal for playback. The audio signal may be played by the speaker to make a sound. For example, the speaker may include a driver configured to move in response to the audio signal. In various examples, the motion of the driver may cause variations in air pressure, including causing audible sounds. The motion of the driver may be modified by one or more ports, such as a bass reflex port. In various embodiments, a port may resonate at a frequency and may change the efficiency of the driver at the frequency. In general, the resonant frequency of the port may be determined by the Helmholtz equation, described above. In various embodiments, characteristics of the port may be changed to change the resonant frequency of the port, which may change the efficiency of the driver, for example to provide better sound fidelity and/or to sound better.

At 204, the audio signal is analyzed to determine a frequency to output. In some examples, the output frequency of the audio signal is determined by applying a Fourier Transformation, or the like, as described above with respect to FIG. 1. Frequency components may be calculated into discrete bins, each of the discrete bins indicating signal strength of a frequency and/or a range of frequencies of the audio signal. Determination of the frequency to output may be performed by the DSP 126 generally, or by a frequency component module as described below in more detail with reference to FIG. 8. For example, the speaker may include a DSP to determine the frequency to output based on analysis of the audio signal.

At 206, a port is selected that is tunable to enhance sound output at the determined frequency. In various embodiments, a speaker may include one or more ports, each of the one or more ports tunable within a range of frequencies. For example, a port may be tuned to any resonant frequency of its associated range of tunable frequencies. In various embodiments, different ports may be tunable to different resonant frequency ranges. Different ports having overlapping resonant frequency ranges are contemplated, including different ports tunable to the same resonant frequency ranges. In various embodiments, a port is selected to be tuned to the determined frequency. For example, the range of resonant frequencies of a port may include the determined frequency, which may qualify the port for selection.

The resonant frequency of the tuned port may generally be determined according to the Helmholtz equation stated above. The resonant frequency of the tuned port may be determined at the time of design and may be stored as a constant available to the port activation module, may be determined from a lookup table, or the like. In some examples, the tuned port may be tuned to a particular resonant frequency, for example by changing one or more physical dimensions of the port. Furthermore, the state of the tuned port may be determined at 206. Accordingly, by determining the state of the one or more changeable physical dimensions, the particular resonant frequency of the tuned port may also be determined. Furthermore, the range of tunable resonant frequencies of a port may be determined based on determining the resonant frequency of the tuned port under various combinations of the shutter position, the port length, or the port area. Similarly, the range of tunable resonant frequencies of a port may be stored as a constant available to the port activation module, may be determined from a lookup table, or the like.

The selection of a port may be based on whether the tunable frequency range of the tuned port includes the determined frequency of the audio signal. In some examples, the strength of the determined frequency is considered in the determination. In various embodiments, these determinations may be performed by the DSP 126 generally, or by a port activation module specifically as described below in more detail with reference to FIG. 8.

At 208, the selected port is tuned to the determined frequency. In various examples, a port may be tuned, for example, by modifying any of the parameters of the Helmholtz equation, such as the length of the port, the degree of openness of the port, the cross sectional area of the port, and so forth. In such cases, the port may be tuned to target a particular resonant frequency of a tunable range. For example, a physical characteristic of a port may be changed by servo, hydraulics, pneumatics, electro-mechanical process, or the like.

In various examples, settings may be determined to tune the port at 204. In general, the settings of the tuned port may be selected for best sound quality and/or fidelity during playback of the audio signal. For example, given the presence of a determined frequency as analyzed at 204, the settings of the tuned port may be determined to tune the port to the determined frequency. The settings may include a shutter setting, a port length setting, a port area setting, or the like.

In general, a frequency of the tuned port may be determined according to the Helmholtz equation stated above. Similarly, the settings to use to tune the port may be determined based on solving the Helmholtz equation for a desired parameter. For example, supposing that a determined frequency to output was found at 204, the Helmholtz equation could be used to determine a degree of shutter openness, a length of the port, and/or an area of the port that, when applied to the port, tune the port to the target frequency and/or activate the port. These settings may be stored in a lookup table, may be based on feedback from the port, may be calculated on the fly, or the like.

The selected port may be tuned by changing the shutter position of the port, the port length, or the port area. In various embodiments, these changes may cause the resonant frequency of the port to change, particularly as described with respect to the Helmholtz equation described above. In various embodiments, the selected port may be tuned using any combination of these changes.

At 210, a shutter position may be changed, for example by actuating the shutter to a particular degree of openness based on the settings. Changes to the openness of the port may correspondingly change the resonant frequency of the tuned port. Changing the shutter position may additionally enable or disable the tuned port. For example, changing the shutter position to closed may disable the tuned port. Additionally, changing the shutter position to open may enable the tuned port.

At 212, the port length is changed to a particular port length based on the settings. As described above, the port length is a physical dimension of the tuned port. Changes to the port length may correspondingly change the resonant frequency of the tuned port.

At 214, the port area is changed to a particular port area based on the settings. As described above, the port area is a physical dimension of the tuned port. Changes to the port area may correspondingly change the resonant frequency of the tuned port.

In various embodiments, tuning the selected port to the determined frequency may be accomplished by changing any one of the shutter position, such as described at block 210, the port length, such as described at block 212, or the port area, such as described at block 214, causing the selected port to be tuned. Therefore, tuning the selected port to the determined frequency may be accomplished by changing as little as a single physical characteristic. Accordingly, any other physical characteristic may be left unchanged. Therefore, the operations represented by any of blocks 210, 212, or 214 may be performed independently of each other, and not all of operations represented by the blocks 210, 212, or 214 need to be performed to tune the selected port. In various embodiments, any combination of the operations represented by the blocks 210, 212, or 214 may be performed in conjunction with each other.

As described above, any change in physical dimension is contemplated to change the resonant frequency of the tuned port. In general, the Helmholtz equation describes the physical dimensions that may be changed to change the resonant frequency of a circular port. Any form of modification to physical dimension is contemplated, including non-circular modification and the like.

In general, the process 200 may be repeated as desired during sound playback over time to achieve optimum sound quality for the currently playing sound. As time progresses the audio signal may change and the process 200 may be repeated to continue to tune the ports of the speaker to enhance the frequencies of the changing audio signal. The process 200 may be performed continuously, may be performed at a specified interval, may be performed as resources permit, or the like.

Figure 3:
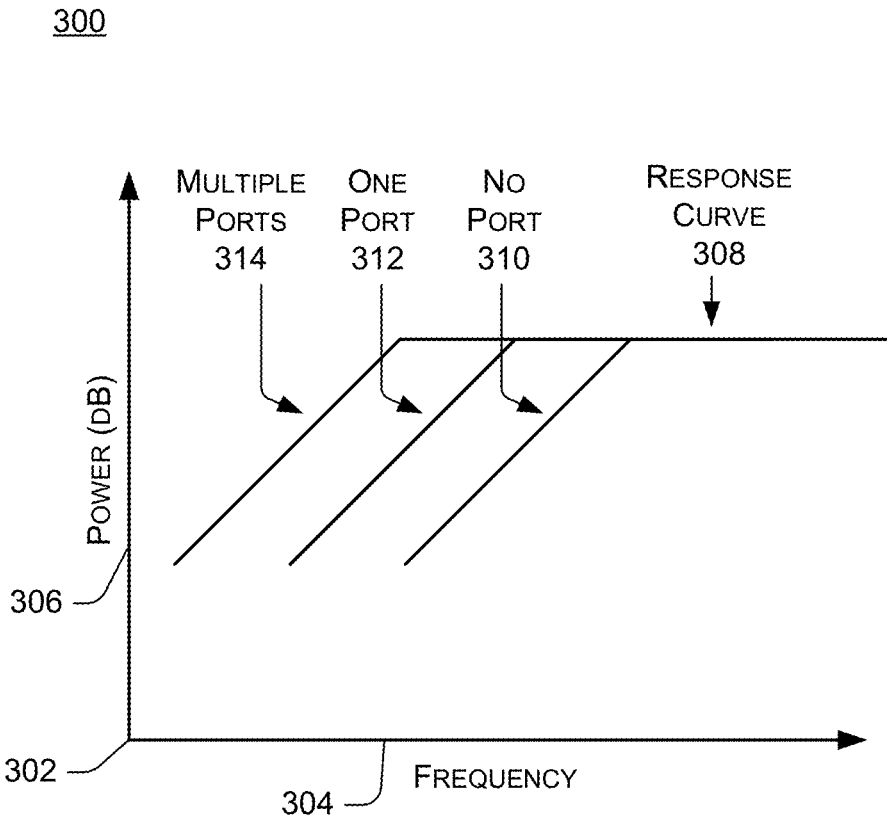
FIG. 3 is an illustrative chart showing speaker efficiency of various port configurations.

FIG. 3 shows illustrative chart 300 showing speaker efficiency of various port configurations. A graph 302 generally illustrates speaker response at various frequencies as a conceptual sketch. The graph 302 is not drawn to scale and does not depict units. Instead, the graph 302 is illustrative and meant for the purpose of discussion as one particular example. Furthermore, as described above, particularly with respect to FIG. 1, open ports may cause degradation and/or loss of fidelity at various frequencies, which may not be depicted in FIG. 3.

The graph 302 includes a frequency axis 304 and a power axis 306. A response curve 308 shows a generally flat response characteristic from mid-range frequencies to high frequencies. A no port curve 310 shows the low frequency response in the absence of a working port, such as a speaker having all of its one or more ports in the closed position. In general, the no port curve 310 shows the weakest low frequency output and may not be able to reproduce the lowest frequency sounds.

A one port curve 312 shows the low frequency response with one port activated, for example when a port is opened. This improves low frequency speaker efficiency, permitting playback of lower frequency sounds and greater efficiency through the low end.

A multiple ports curve 314 shows the low frequency response with multiple ports activated, for example when two or more ports are opened. The frequency response of multiple ports curve 314 is improved well into the lower frequencies, and the speaker is capable of producing very low frequency sounds unavailable on the no port response curve 310.

Thus, the advantage of using multiple ports can be seen in the graph 302 as the greater range of the response curve 308 into the low frequencies, for example as depicted by the multiple ports curve 314. In addition to greater frequency range, the multiple ports curve 314 also has greater efficiency in the low frequency ranges and can produce more power at many lower frequencies. However, the graph 302 does not generally show the disadvantages of opening one or more ports. In some embodiments, each port may contribute to a loss of fidelity, for example by introducing transient noise and/or reducing efficiency at other frequency ranges. Accordingly, it may be advantageous to only open one or more ports when playing sounds that require the advantages of the opened one or more ports, such as when playing low frequency sounds.

Figure 4:
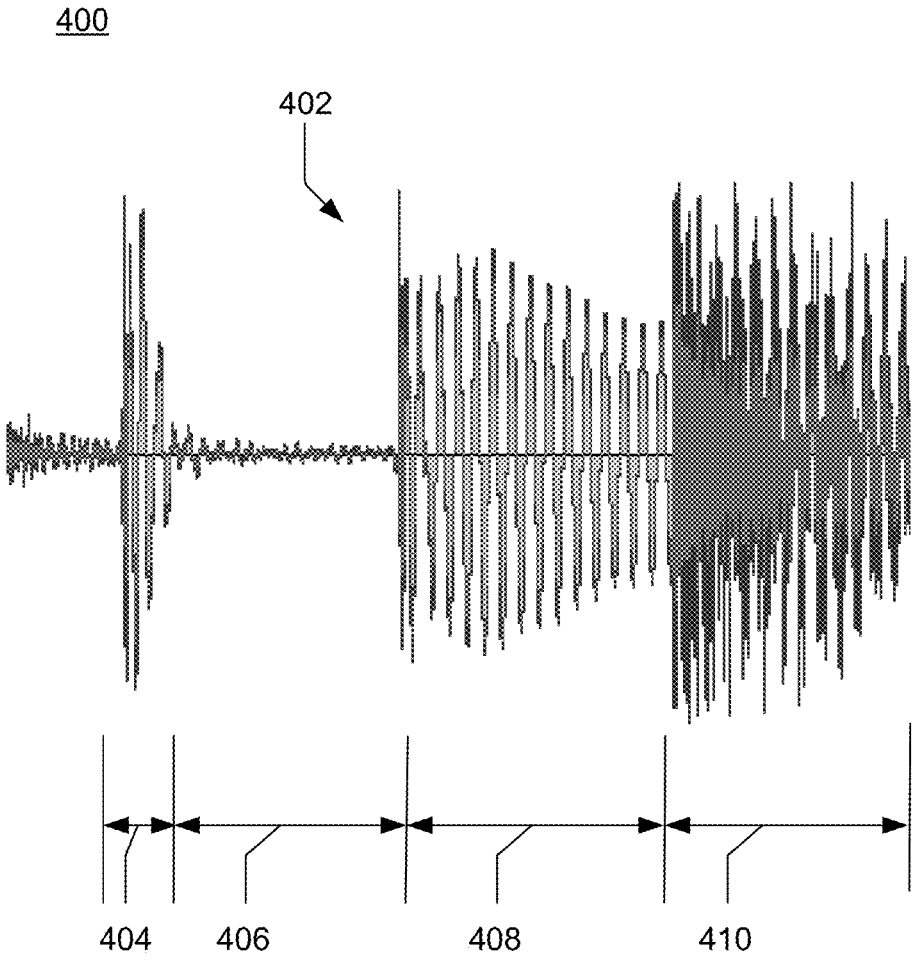
FIG. 4 is an illustrative waveform including a sound sample having different frequency characteristics over time.

FIG. 4 shows an illustrative waveform including sound sample 400 having different frequency characteristics over time. A waveform 402 is illustrated showing sound output over time. The waveform 402 is divided into four sections, a first section 404, a second section 406, a third section 408 and a fourth section 410, where each section has different sound characteristics. The waveform 402 generally depicts a sound in the time domain, therefore the frequency components may not be immediately discernible from the waveform 402 itself.

The first section 404 depicts a period of some activity in a first frequency range corresponding to a first tuned port. The port activation module may open the first tuned port to improve efficiency during playback of the first section 404. Other ports tuned to frequencies not existing during the first section 404 may be closed.

The second section 406 depicts a period of low activity in the lower frequencies. In this example, none of the ports are tuned to provide improved efficiency to the sound played during the second section 406. Therefore, the port activation module may close all of the ports.

The third section 408 depicts a period of some activity in a second frequency range corresponding to a second tuned port. The port activation module may open the second tuned port to improve efficiency during playback of the third section 408. Other ports tuned to frequencies not existing during the first section 408 may be closed.

The fourth section 410 depicts a period of activity in the first frequency range and the second frequency range. The port activation module may open the first tuned port and the second tuned port to improve efficiency during playback of the fourth section 410.

The first section 404, the third section 408, and the fourth section 410 each benefit from improved efficiency attributable to the open ports. However, each of the open ports introduces the possibility of degrading sound quality. Despite this, the system may sound better as a whole, including any degradation, compared to a system lacking ports. Furthermore, closing the ports when unneeded may reduce negative effects to sound quality that open ports may typically present. For example, during the second section 406, no ports may be open and therefore no sound artifacts may be introduced by the ports. Thus, the speaker described herein may have advantages throughout the frequency range and improved overall sound quality compared to a traditional speaker.

Figure 5:
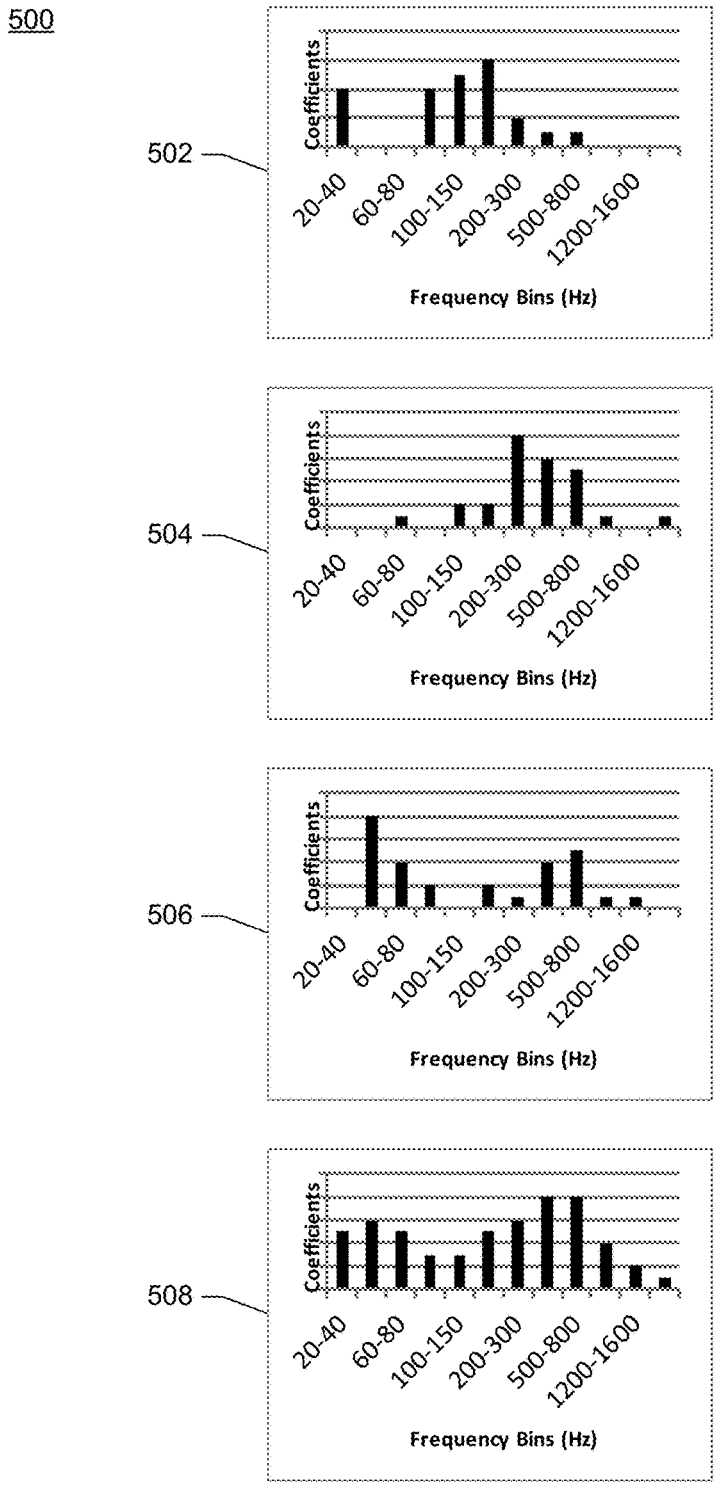
FIG. 5 is an illustrative series of charts showing sound activity in various frequency bins.

FIG. 5 shows illustrative charts showing sound activity in various frequency bins 500. In general, frequency bins indicate the presence of particular frequencies in a sample sound, the frequencies measured in Hertz (Hz). A range of frequencies may be grouped together as a bin. In general, the frequency bins may be calculated by an FFT, or the like, as described herein, particularly with respect to the frequency component module of FIG. 2. Typically, bin sizes may cover equal frequency ranges. In this example, illustrative frequency bins 500 depict the lower frequency bins with greater resolution (i.e. smaller bin size) to better describe the activity in the lower frequency ranges. In general, discrete bins are shown, although a continuous frequency domain is contemplated throughout.

In general, a Fourier transformation may decompose a sequence of values into components of different frequencies, for example to extract the frequency components of the sequence of values. An audio signal may comprise a sequence of values, for example an audio signal may comprise amplitudes of the represented sound sampled at uniform intervals. In various embodiments, the audio signal may also be an analog signal, comprising a continuous amplitude signal over a continuous period of time to represent a sound. Accordingly, a Fourier transformation of the audio signal may decompose the audio signal into component frequencies individually associated with coefficients. In various embodiments, the component frequencies may be binned into frequency ranges, called bins, and the associated coefficients may represent the magnitude of the frequency bin in the decomposition of the audio signal. In general, the coefficient associated with a bin may indicate an energy level of the frequency range of the bin. For example, the coefficient associated with a bin may be calculated by the square root of the product of the real and imaginary portions of an FFT result. In some examples, only the real portion may be calculated, and the imaginary part may be ignored. In general, a non-zero coefficient associated with a bin may indicate that a tuned port having the same or similar resonant frequency may improve efficiency of the system when playing the audio signal.

FIG. 5 refers back to FIG. 4 and incorporates the discussion of FIG. 4 throughout.

A first set of bins 502 depicts an example frequency binning of a sample of the first section 404. As discussed above, the first section 404 included frequencies corresponding to the first tuned port. The first set of bins 502 depicts this as the sounds in the frequency range 20-40 Hz. Accordingly, the bin describing 20-40 Hz corresponds to the resonant frequency of the first tuned port, which may be opened during playback of the first section 404.

A second set of bins 504 depicts an example frequency binning of a sample of the second section 406. As discussed above, the second section 406 has a low or zero coefficient associated with the bins corresponding to the first tuned port or the second tuned port. The second set of bins 504 similarly shows low or zero coefficient associated with bins that represent the middle and high ranges, with low or zero coefficient associated with the bin representing the frequency range from 20-60 Hz. Thus, neither the first nor second port may be opened during playback of the second section 406.

A third set of bins 506 depicts an example frequency binning of a sample of the third section 408. As discussed above, the third section 408 has a non-zero coefficient associated with the bins corresponding to the resonant frequency of the second tuned port, depicted here as the sounds in the frequency range 40-60 Hz. Accordingly, the bin describing 40-60 Hz corresponds to the second tuned port, which may be opened during playback of the third section 408.

A fourth set of bins 508 depicts an example frequency binning of a sample of the fourth section 410. As discussed above, the fourth section 410 has a non-zero coefficient associated with the bins corresponding to the resonant frequency of the first tuned port and the second tuned port. The fourth set of bins 508 shows a non-zero coefficient in both the 20-40 Hz range as well as the 40-60 Hz range, corresponding to the resonant frequencies of both the first port and the second port, which both may be opened during payback of the fourth section 410.

As described above, a tuned port may be opened when there is a non-zero coefficient associated with a bin having a frequency range corresponding to the resonant frequency of the tuned port. In some examples, a threshold level of activity may be required to open the corresponding tuned port. In some examples, a tuned port may be actively re-tuned to another frequency within a frequency range of the tuned port to improve speaker efficiency for a frequency range associated with a non-zero coefficient, as described above. In some examples, the frequency range of a tuned port may correspond to more than one bin, and a non-zero coefficient associated with any of the corresponding bins may prompt opening the corresponding port. In some examples, a single bin may correspond to multiple ports, thus a non-zero coefficient associated with the single bin may prompt ones of the multiple ports to open.

In some embodiments, upon detection of an audio signal susceptible to distortion caused by one or more activated ports, the one or more activated ports may be disabled irrespective of a non-zero coefficient associated with the associated frequency ranges of the one or more activated ports. Distortion susceptible sounds may include transient sounds or sounds having undesirable resonance with one or more ports. For example, the fourth set of bins 508 generally shows non-zero coefficients associated with the bins representing the 500-800 Hz range that may justify disabling one or more ports so that the audio signal may be played without introducing distortion or other loss of sound quality caused by the activated ports. In this example, the lower frequencies may suffer, however the overall sound quality may be improved.

Figure 6:
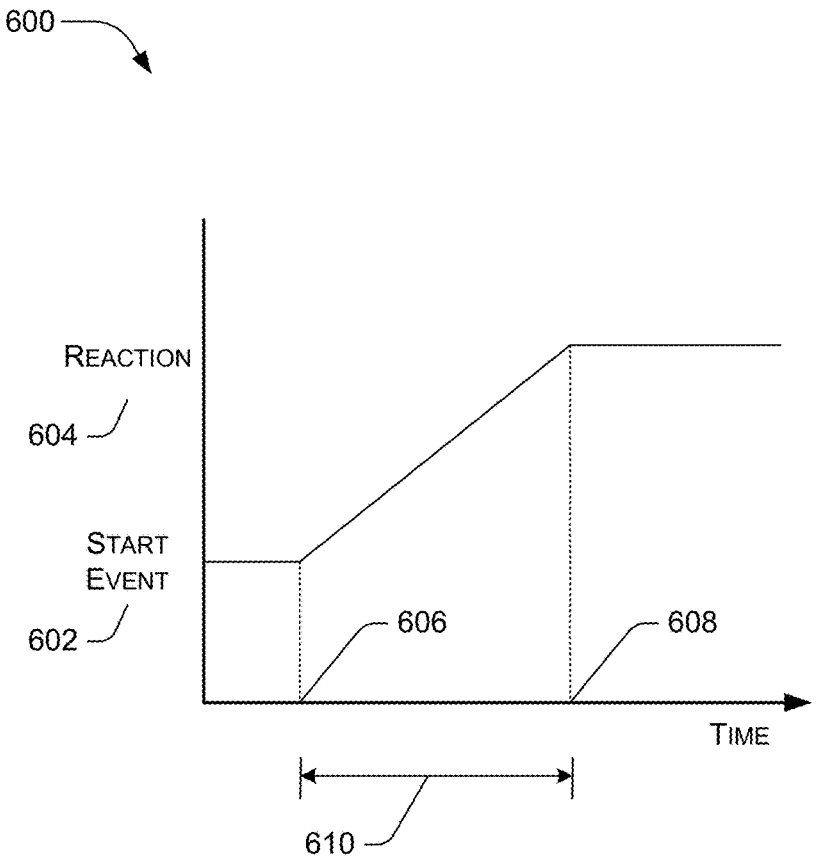
FIG. 6 is an illustrative chart showing response time delay from the time an audio signal is received until the time a port is tuned.

FIG. 6 depicts an illustrative process 600 to actuate a component toward a setting. The process is illustrated as a collection of blocks in a logical flow graph, which represent a sequence of operations that can be implemented in hardware, software, or a combination thereof. In the context of software, the blocks represent computer-executable instructions stored on one or more computer-readable storage media that, when executed by one or more processors, perform the recited operations. Generally, computer-executable instructions include routines, programs, objects, components, data structures, and the like that perform particular functions or implement particular abstract data types. The order in which the operations are described is not intended to be construed as a limitation, and any number of the described blocks can be combined in any order and/or in parallel to implement the processes.

FIG. 6 is an illustrative chart 600 showing a response time delay from the time an audio signal is received until the time a port is tuned. Tuning a port may occur as described throughout, particularly with respect to FIG. 2, which may occur over a period of time. In general, a response time is the amount of time that elapses between a start event 602 and a reaction 604 that occurs in response to the start event 602. For example, the start event 602 may occur at a start time 606, which may start one or more actions leading to the reaction 604 that occurs at an end time 608. A reaction time 610 may thus be the time elapsed between the start time 606 and the end time 608.

The start event 602 may be when an audio signal is received, for example as generally described at block 202 of FIG. 2 and elsewhere. The reaction 604 may include the time needed to tune a selected port to a determined frequency, for example as generally described at blocks 208, 210, 212, and 214 of FIG. 2 and elsewhere. The reaction time 610 may comprise one or more delays between the start event 602 and the reaction 604. For example, the one or more delays may include combinations of a delay attributable to a control circuit (such as propagation and/or processing delays) and a delay attributable to an actuation mechanism (such as the time to change a shutter position, change a port length, change a port area, or the like).

In various embodiments, the reaction time 610 may include a period of time during which the port is not tuned to the determined frequency. Thus, the tuning of a port may lag behind the playback of the audio signal. Some audio signals may be very narrow in the time domain, such as a sharp signal of a drum beat, and may suffer greater signal degradation from a longer reaction time 610 compared to signals that are relatively wider in the time domain.

In various embodiments, techniques may be used to reduce the duration of the reaction time 610. For example, the reaction time 610 may be kept as low as possible so that the physical component actuates at the same time as the playback of a sound having a particular frequency output. For example, the shutter response time may be kept below the order of inverse of the playback sampling frequency to provide quick response.

In various embodiments, techniques may be used to reduce the perceived effect of the reaction time 610. For example, assuming that the audio signal played at the start time 606 includes a frequency to output, a port may be tuned to the frequency to output at or before the start time 606, so that when the audio signal is played at start time 606 there is no delay until the end time 608 so that the reaction time 610 is perceived to have no delay. In some embodiments, the port may be tuned to the frequency to output at or before the start time 606 by beginning the tuning process before the start time 606, for example by beginning before the start time 606 at least a period of time equal to the reaction time 610.

In various embodiments, playback of the audio signal may be delayed to reduce the effect of the reaction time 610. For example, supposing that the reaction time 610 is 20 ms, playback of the audio signal may be delayed 20 ms to allow time for processing delays and actuation delays, so that the port may be tuned to the determined frequency before playback of the audio signal. In some embodiments, the played audio signal may be delayed by storing the audio signal for a period before playback and/or by introducing a signal delay such as via a longer wire.

In various embodiments, the audio signal may be part of a stream of audio signals, and the stream of audio signals may be read ahead of playback to reduce the effect of the reaction time 610. For example, when playing a music file as a stream of audio signals, portions of the music file can be read ahead of time to determine when to tune the selected port before playback of the portion of the audio signal that was read ahead of time. The port may thus be tuned prior to playback of a particular frequency to compensate for the response time.

In some examples, the music file may be formatted to store data in the frequency domain, for example as part of a compression scheme. In embodiments where the sound file already includes a description of the frequency domain, then the frequency components of the sound may not need to be calculated because the frequency components are already present in the music file. For example, if an audio file itself indicates frequencies to output in a frequency range corresponding to a resonant frequency of a tuned port, then the port may be activated as described herein without performing a step to calculate the frequency components.

Figure 7:
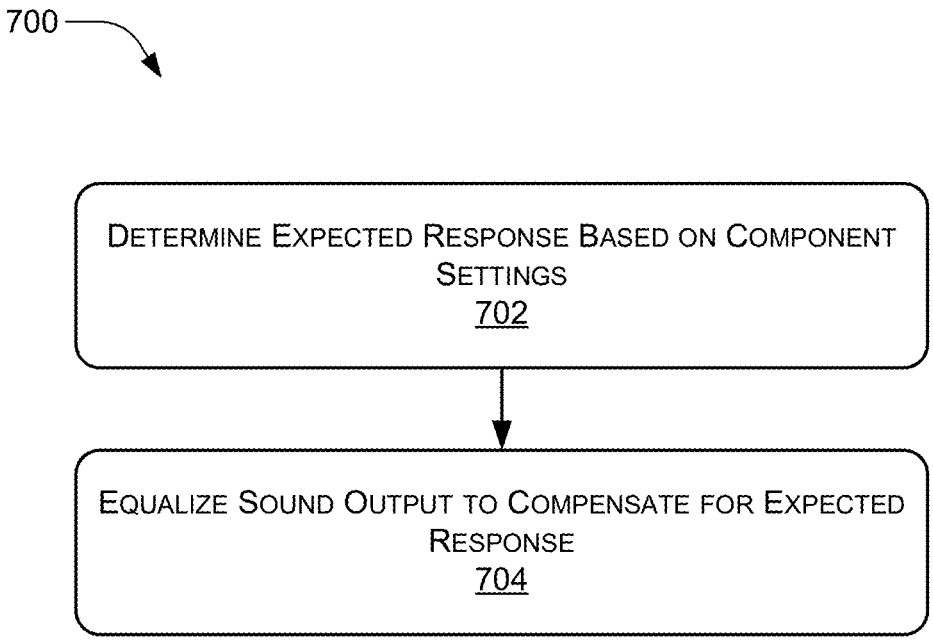
FIG. 7 is a flowchart showing an illustrative process to apply an equalizer to compensate for different port settings.

FIG. 7 depicts an illustrative process 700 to apply an equalizer to compensate for different port settings. The process is illustrated as a collection of blocks in a logical flow graph, which represent a sequence of operations that can be implemented in hardware, software, or a combination thereof. In the context of software, the blocks represent computer-executable instructions stored on one or more computer-readable storage media that, when executed by one or more processors, perform the recited operations. Generally, computer-executable instructions include routines, programs, objects, components, data structures, and the like that perform particular functions or implement particular abstract data types. The order in which the operations are described is not intended to be construed as a limitation, and any number of the described blocks can be combined in any order and/or in parallel to implement the processes.

FIG. 7 shows a process 700 performed using the DSP 126 and/or on the amplifier 122, as described above, particularly with respect to FIGS. 1, 3, and 6.

At 702, the DSP 126 and/or amplifier 122 determines an expected response based on settings of the components of one or more active ports. A setting of the settings may indicate how open the shutter currently is, how long a port is, and/or how large the cross-sectional area of a port is, thereby facilitating a determination of a resonant frequency of the port based on the shutter state and the physical state of the port. In one embodiment, a port state may indicate the current settings of a port, facilitating a determination of the resonant frequency of the port based on the current settings of the port. In some examples, the settings may be provided by a component, and/or stored on the DSP 126 based on actuation signals associated with a changeable component. In some examples, the component state may be provided by the component and/or stored on the DSP 126 based on component change signals. The expected response may be a graph of speaker efficiency at various frequencies. For example, the graph 302 of FIG. 3 may illustrate the expected response for the listed conditions, for example the no port curve 310.

In some examples, the expected response may be represented as a look-up table, for example by looking-up the current setting to determine a response curve. In some examples, the expected response may be determined from actual playback, such as with a microphone. In some examples, the expected response may be interpolated from one or more other expected response curves for other settings, for example when a shutter is halfway open, the expected response may be interpolated from an expected response for a closed shutter and an expected response for an open shutter.

At 704, the DSP 126 and/or amplifier 122 may equalize sound output to compensate for the expected response. For example, the expected response may be used to determine how an audio signal will sound when played, which may be analyzed to determine variations from a desired response that may be compensated-for by applying corrective equalization values. In general, an equalizer may be configured to boost or cut the signal strength of one or more frequency components of an audio signal. In various embodiments, the corrective equalization values may modify an audio signal to reduce the variations of the frequency components from the desired response. In general, it may be desirable to produce a flat response curve to play the sound with greatest fidelity. However, any other response curve may be desired, such as when the user 102 specifies an equalizer setting. In the example of the no port curve 310, the speaker is less efficient at low frequencies (and may not even reach the lowest frequencies). Accordingly, to playback a low frequency sound, the volume for the low frequency may be turned up, adding a positive equalizer setting for the low frequency. Thus, the extra volume applied to the low frequency may thereby produce a flat response to compensate for the inefficiency of the speaker at the low frequency. In general, the frequency adjustments made to balance frequency response are applied by equalizer using an equalization curve. The equalizer generally adjusts the output at frequencies as described by the equalization curve.

Similarly, when a tuned port is enabled to improve efficiency for a particular frequency, an equalization setting that reduces the output energy of the particular frequency may be applied to produce a flat response.

Furthermore, as the component actuates as described above, particularly with respect to FIG. 6, the expected response may transition over time as the component actuates. Accordingly, the equalizer may adjust in sync with the transitioning physical component actuation to attempt to provide a continuously flat response.

In some examples, the equalizer may be part of the amplifier 122. In some examples, the equalizer may be a separate unit positioned between the amplifier 122 and the speakers, such as the front view speaker 104 and/or the cross-section view speaker 106.

Figure 8:
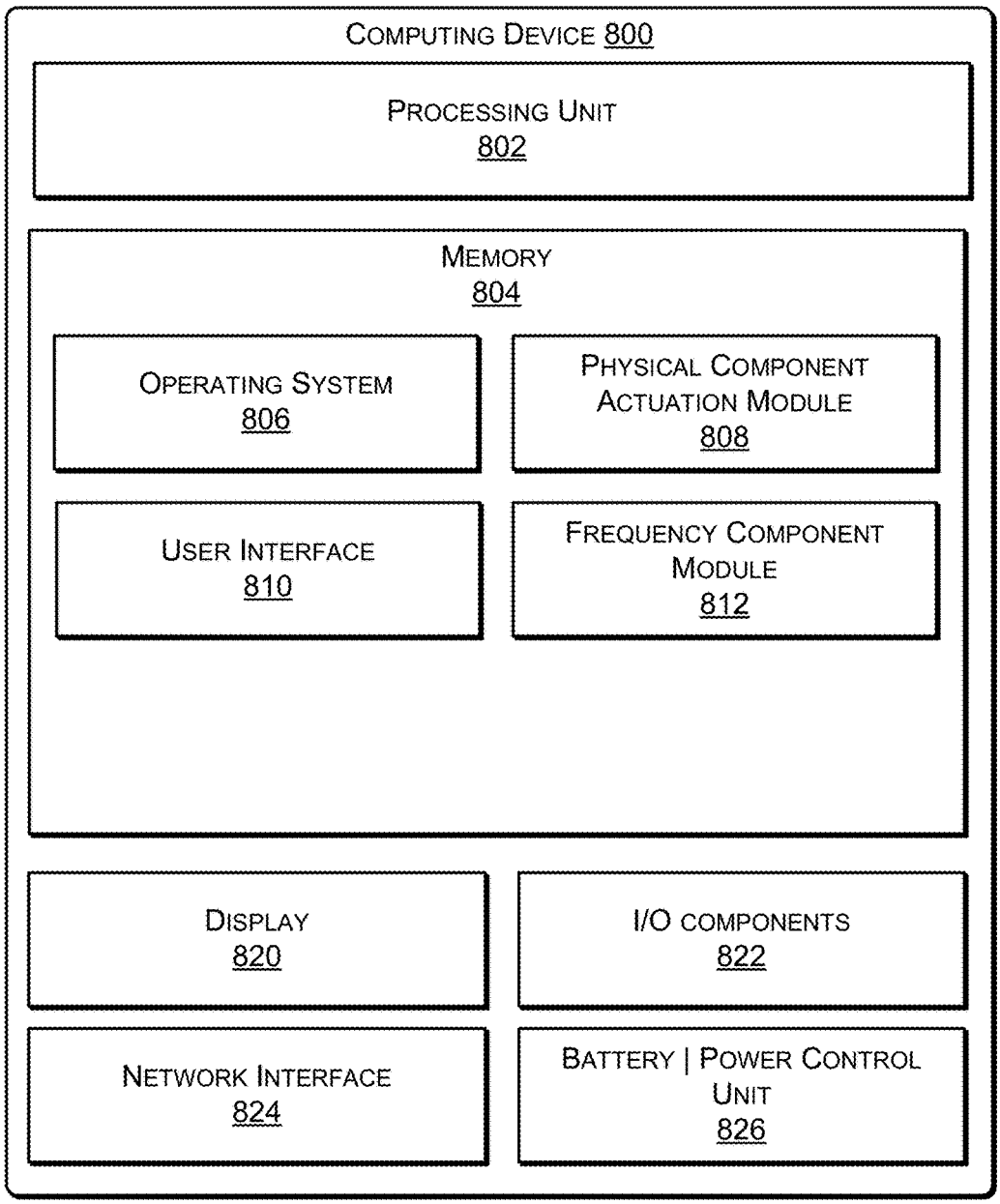
FIG. 8 is a block diagram showing relevant components of an electronic device to operate a smart bass reflex loudspeaker.

FIG. 8 illustrates relevant components that might be implemented in the computing device 800 to operate a smart bass reflex loudspeaker. In this embodiment, the computing device 800 is equipped to perform actuation of the shutters of a smart bass reflex loudspeaker. The computing device 800 may be representative of the DSP 126 discussed with reference to FIG. 1.

In a very basic configuration, the computing device 800 includes a processing unit 802 composed of one or more processors, and memory 804. Depending on the configuration of the computing device 800, the memory 804 is an example of computer storage medium and may include volatile and nonvolatile memory. Embodiments may be provided as a computer program product including a non-transitory machine-readable storage medium having stored thereon instructions (in compressed or uncompressed form) that may be used to program a computer (or other electronic device) to perform processes or methods described herein. The machine-readable storage medium may include, but is not limited to, hard drives, floppy diskettes, optical disks, CD-ROMs, DVDs, read-only memories (ROMs), random access memories (RAMs), EPROMs, EEPROMs, flash memory, magnetic or optical cards, solid-state memory devices, or other types of media/machine-readable medium suitable for storing electronic instructions. Further, embodiments may also be provided as a computer program product including a transitory machine-readable signal (in compressed or uncompressed form). Examples of machine-readable signals, whether modulated using a carrier or not, include, but are not limited to, signals that a computer system or machine hosting or running a computer program can be configured to access, including signals downloaded through the Internet or other networks. For example, distribution of software may be by an Internet download.

The memory 804 may be used to store any number of functional components that are executable on the processing unit 802, as well as data and media items that are rendered by the computing device 800. Thus, the memory 804 may store an operating system 806 and modules to activate ports and determine frequency components, such as a physical component actuation module 808 and a frequency component module 812.

The physical component actuation module 808 may activate one or more physical components of one or more corresponding ports. In some embodiments, each port may be associated with a single instance of a physical component actuation module 808. In some embodiments, a single physical component actuation module 808 may activate the associated physical components of multiple ports. In general, the physical component actuation module 808 may signal, actuate, or cause to be actuated a physical component to a particular state, such as opened, closed, partway open, set to a particular length, set to a particular cross-sectional area, or the like. Additionally, the physical component actuation module 808 may be aware of the state of the physical component and may provide the state information to other modules to help determine an expected response of a speaker. The physical component actuation module 808 may be used to perform many of the actions shown in the processes of FIGS. 2, 6, and 7 relating to physical component control.

A user interface module 810 may also be provided in the memory 804 and executed on the processing unit 802 to provide for user operation of the device 800. The UI module 810 may provide menus and other navigational tools to facilitate selection and rendering of the media items, such as the eBooks. The UI module 810 may further include a browser or other application that facilitates access to sites over a network, such as websites or online merchants, or other sources of electronic content items or other products.

The UI module 810 may include a content presentation application that renders the media items. The content presentation application may be implemented as various applications depending upon the media items. For instance, the application may be an eBook reader application for rending eBooks, or an audio player for playing audio books, or a video player for playing video, and so forth.

The frequency component module 812 may determine the component frequencies of a played sound. For example, an FFT may be performed on the played sound to determine the component frequencies. Accordingly, the frequency component module 812 may communicate with the physical component actuation module 808 to cause a port tuned to a particular resonant frequency to open during playback of that particular frequency. The frequency component module 812 may be used to perform some of the actions shown in the processes of FIGS. 2 and 7 relating to frequency determination.

The computing device 800 may further include a display 820 upon which DSP operations may be rendered. Some exemplary displays that may be used with the implementations described herein include e-paper, liquid crystal displays (LCDs), or the like. Touch sensitive technology may be overlaid or integrated with the display to enable user input via contact or proximity to the screen.

The computing device 800 may further be equipped with various input/output (I/O) components 822. Such components may include various user interface controls (e.g., mice, trackpad, joystick, keyboard, etc.), audio speaker, connection ports, and so forth.

A network interface 824 supports both wired and wireless connection to various networks, such as cellular networks, radio, Wi-Fi networks, short range networks (e.g., Bluetooth), infrared (IR), and so forth. The network interface 824 facilitates receiving content as discussed herein.

The computing device 800 may also include a battery and power control unit 826. The power control unit operatively controls an amount of power, or electrical energy, consumed by the computing device. Actively controlling the amount of power consumed by the computing device may achieve more efficient use of electrical energy stored by the battery.

The computing device 800 may have additional features or functionality. For example, the computing device 800 may also include additional data storage devices (removable and/or non-removable) such as, for example, magnetic disks, optical disks, or tape. The additional data storage media may include volatile and nonvolatile, removable and non-removable media implemented in any method or technology for storage of information, such as computer readable instructions, data structures, program modules, or other data.

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims. For example, the methodological acts need not be performed in the order or combinations described herein, and may be performed in any combination of one or more acts.

What is claimed is:

1. A method for selectively tuning a port from a plurality of ports of a speaker, the method comprising:

receiving an audio signal, the audio signal including a plurality of audio signal components, wherein an individual audio signal component of the plurality of audio signal components has an associated frequency;

analyzing, by the speaker, the audio signal to determine a first audio signal component to be output from the plurality of audio components, the first audio signal component having an associated first frequency, analyzing the audio signal comprising performing a Fast Fourier Transform (FFT) of the audio signal;

selecting, based at least in part on the first frequency, a first port from the plurality of ports for tuning, wherein:

the first port is tunable within a first frequency range, the first frequency being within the first frequency range; and a second port of the plurality of ports is tunable within a second frequency range based at least in part on received audio signals;

tuning the first port to the first frequency to output the first audio signal component, wherein tuning the first port comprising one or more of:

changing a shutter position of a shutter coupled to the first port;

changing a length of the first port; or changing a cross-sectional area of the first port; and outputting sound represented by the audio signal.

2. The method of claim 1, wherein analyzing the audio signal comprises creating a time domain representation of a sample of the audio signal, and wherein performing the FFT comprises converting the time domain representation of the sample to a frequency domain representation of the sample.

3. The method of claim 1, further comprising:

analyzing, by the speaker, the audio signal to determine a second audio signal component to be output from the plurality of audio components, the second audio signal component having an associated second frequency;

selecting the second port from the plurality of ports, wherein the second frequency is within the second frequency range; and tuning the second port to the second frequency to output the second audio signal component, wherein tuning the second port comprising one or more of:

changing a shutter position of a shutter coupled to the second port;

changing a length of the second port; or changing a cross-sectional area of the second port.

4. A method for tuning a plurality of ports of a speaker, the method comprising:

analyzing an audio signal to determine a frequency component of the audio signal;

selecting, based at least in part on the frequency component, a first port to tune from the plurality of ports of the speaker, the first port being tunable within a first frequency range, wherein the frequency component of the audio signal is within the first frequency range;

tuning the first port to the frequency component, wherein tuning the first port comprises changing at least one or more of:

a shutter position of the first port, a length of the first port, or a cross-sectional area of the first port;

deactivating at least a second port of the plurality of ports; and outputting sound represented by the audio signal.

5. The method of claim 4, further comprising opening the first port to enable the first port.

6. The method of claim 4, further comprising:

analyzing the audio signal to determine a strength associated with a frequency range measuring below a threshold strength, the frequency range corresponding to a second tunable frequency range of the second port of the plurality of ports, wherein the second port is not the first port, and wherein deactivating the second port comprises closing the second port to disable the second port.

7. The method of claim 4, wherein analyzing the audio signal comprises performing a Fast Fourier Transformation (FFT) of the audio signal to determine the frequency component.

8. The method of claim 4, wherein determining the frequency component comprises determining the frequency component based, at least in part, on a strength associated with the frequency component exceeding a threshold level of activity.

9. A device comprising:

a driver;

a plurality of ports, the plurality of ports including at least:

a first port that is tunable within a first tunable frequency range based at least in part on received audio signals; and a second port that is tunable within a second tunable frequency range based at least in part on the received audio signals; and one or more non-transitory computer readable media storing computer-executable instructions that, when executed by one or more processors, cause the one or more processors to perform acts comprising:

receiving an audio signal;

analyzing the audio signal to determine a frequency component of the audio signal;

selecting the first port of the plurality of ports for tuning based, at least in part, on the frequency component of the audio signal being within the first tunable frequency range associated with the first port; and outputting sound represented by the audio signal.

10. The device of claim 9, wherein the first port of the plurality of ports is tunable by changing a shutter position of the first port, changing a length of the first port, or changing a cross-sectional area of the first port.

11. The device of claim 9, wherein the computer-executable instructions, when executed by the one or more processors, further perform acts comprising determining settings to tune the first port to the frequency component, the settings indicating at least one of a shutter position of the first port, a length of the first port, or a cross-sectional area of the first port.

12. The device of claim 11, further comprising:

one or more actuators associated with the first port to change at least one of the shutter position of the first port, the length of the first port, or the cross-sectional area of the first port based, at least in part, on the settings.

13. The device of claim 9, wherein the computer-executable instructions, when executed by the one or more processors, further perform acts comprising:

analyzing the audio signal to determine a strength associated with a frequency range measuring below a threshold strength, the frequency range corresponding to the second tunable frequency range associated with the second port; and closing the second port.

14. The device of claim 9, wherein the computer-executable instructions, when executed by the one or more processors, further perform acts comprising determining the frequency component based, at least in part, on performing a Fast Fourier Transformation (FFT) of the audio signal.

15. The device of claim 14, wherein analyzing the audio signal comprises creating a time domain representation of a sample of the audio signal, and wherein performing the FFT comprises converting the time domain representation of the sample to a frequency domain representation of the sample.

16. The method of claim 9, wherein the computer-executable instructions, when executed by the one or more processors, further perform acts comprising tuning the first port before a playback of the audio signal.

17. The device of claim 11, wherein the computer-executable instructions, when executed by the one or more processors, further perform acts comprising:

determining an expected response based, at least in part, on settings associated with the first port; and determining an equalization setting to compensate for the expected response based, at least in part, on the expected response.

18. The device of claim 17, wherein:

the expected response includes a frequency component having a variation from a flat response curve, and the equalization setting reduces the variation from the flat response curve.

19. The method of claim 1, further comprising closing at least the second port of the plurality of ports based, at least in part, on selecting the first port.

20. The method of claim 1, wherein before tuning the first port to the first frequency, the method further comprises:

opening the first port based, at least in part, on selecting the first port; and closing the second port based, at least in part, on selecting the first port.

* * * * *